US009405215B2

(12) United States Patent
Masui

(10) Patent No.: US 9,405,215 B2
(45) Date of Patent: Aug. 2, 2016

(54) DEVELOPER SUPPLY MEMBER, DEVELOPING UNIT, AND IMAGE FORMING APPARATUS

(71) Applicant: Oki Data Corporation, Tokyo (JP)

(72) Inventor: Naoki Masui, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/717,822

(22) Filed: May 20, 2015

(65) Prior Publication Data

US 2015/0338771 A1 Nov. 26, 2015

(30) Foreign Application Priority Data

May 23, 2014 (JP) ..... 2014-106905

(51) Int. Cl.
*G03G 15/08* (2006.01)

(52) U.S. Cl.
CPC ..... *G03G 15/0808* (2013.01)

(58) Field of Classification Search
None
See application file for complete search history.

(56) References Cited

U.S. PATENT DOCUMENTS

2006/0051128 A1* 3/2006 Takahata ..... G03G 15/00 399/116
2014/0029987 A1* 1/2014 Masui ..... G03G 15/0865 399/281

FOREIGN PATENT DOCUMENTS

JP 2002-108090 A 4/2002
JP WO 2008136487 A1 * 11/2008 ..... G03G 15/0818

* cited by examiner

*Primary Examiner* — Clayton E Laballe
*Assistant Examiner* — Victor Verbitsky
(74) *Attorney, Agent, or Firm* — Rabin & Berdo, P.C.

(57) ABSTRACT

A developer supply member, a developing unit, and an image forming apparatus are provided that maintain high-quality image forming. The developer supply member includes: a rotation shaft; a base material which covers the rotation shaft and has a closed-cell foam structure containing a silicone rubber as a main constituent; and a coating film formed on an outer surface of the base material. The developer supply member satisfies an expression of $T \geq -0.15 \times H + 9.6$, and $54 \leq H \leq 69$, where T is a thickness of the coating film measured in micrometers and H is Asker F hardness measured in degrees on a surface of the coating film.

11 Claims, 9 Drawing Sheets

DEVELOPER SUPPLY MEMBER, DEVELOPING UNIT, AND IMAGE FORMING APPARATUS

BACKGROUND OF THE INVENTION

1. Field of the Invention

The present invention relates to a developer supply member, a developing unit, and an image forming apparatus.

2. Description of the Related Art

An electrophotographic image forming apparatus generally uses a developing unit which supplies a developer to a photosensitive drum. For example, a developing unit described in Japanese Patent Application Publication No. 2002-108090, patent reference 1, includes a developing roller which supplies a developer to a photosensitive drum and a supply roller which supplies the developer to the developing roller.

SUMMARY OF THE INVENTION

In recent years, it has been possible for electrophotographic image forming apparatuses to perform image forming at higher speed and to produce higher-resolution images. Accordingly, high image quality has been required.

An object of the present invention is to provide a developer supply member, a developing unit, and an image forming apparatus capable of maintaining high-quality image forming.

A developer supply member according to an aspect of the present invention includes a rotation shaft, a base material which covers the rotation shaft and has a closed-cell foam structure containing a silicone rubber as a main constituent; and a coating film formed on an outer surface of the base material; the developer supply member satisfying an expression of $T \geq -0.15 \times H + 9.6$, where T is a thickness of the coating film measured in micrometers and H is Asker F hardness measured in degrees on a surface of the coating film.

A developer supply member according to another aspect of the present invention includes a rotation shaft; a base material which covers the rotation shaft and has a closed-cell foam structure containing a silicone rubber as a main constituent; and a coating film formed on an outer surface of the base material; the developer supply member satisfying an expression of $T \leq 0.1 \times H - 3.9$, where T is a thickness of the coating film measured in micrometers and H is Asker F hardness measured in degrees on a surface of the coating film.

A developer supply member according to another aspect of the present invention includes a rotation shaft, a base material which covers the rotation shaft and has a closed-cell foam structure containing a silicone rubber as a main constituent; and a coating film formed on an outer surface of the base material; the developer supply member satisfying expressions of $T \leq 0.08 \times H - 3.58$ and $T \geq -0.27 \times H + 18.1$, where T is a thickness of the coating film measured in micrometers and H is Asker F hardness measured in degrees on a surface of the coating film.

According to the present invention, it is possible to provide a developer supply member, a developing unit, and an image forming apparatus capable of maintaining high-quality image forming.

DETAILED DESCRIPTION OF THE INVENTION

An embodiment of the invention will now be described with reference to the attached drawings.

(Image Forming Apparatus 1)

Figure 1:
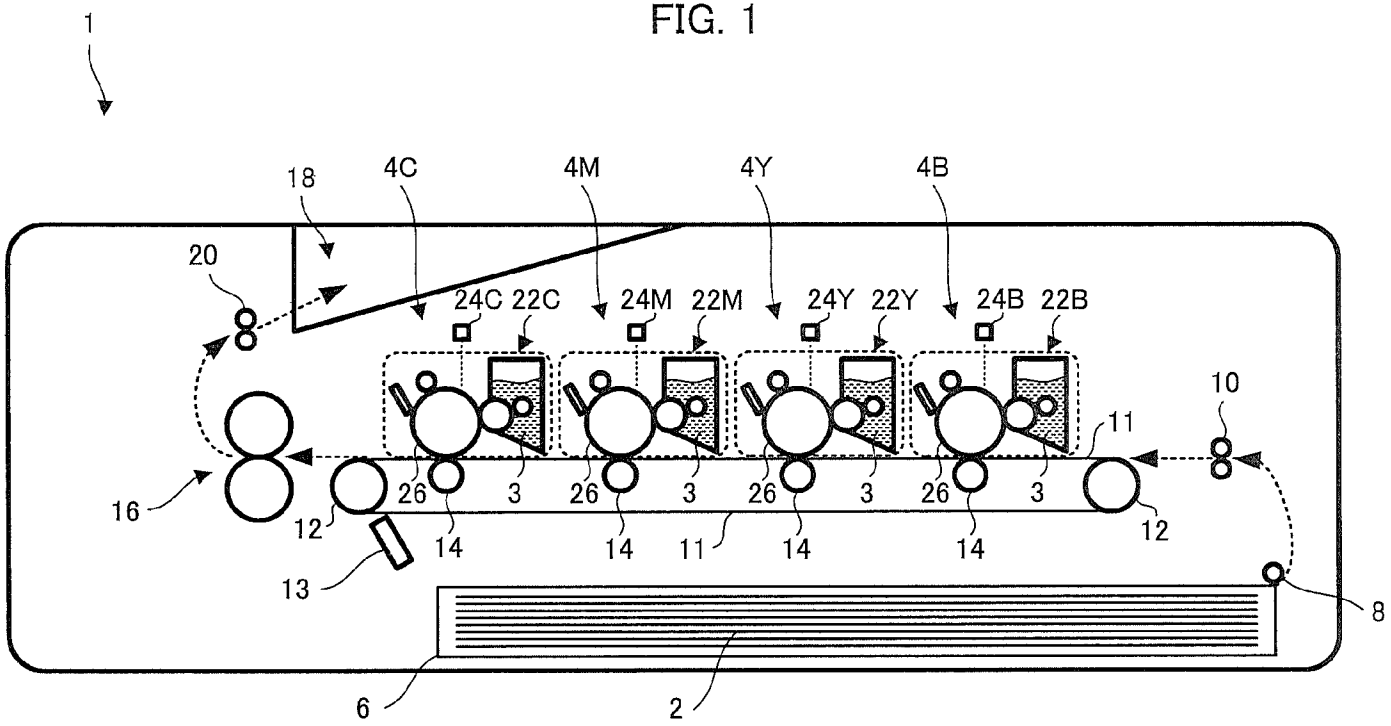
FIG. 1 is a cross-sectional view schematically showing internal structure of an image forming apparatus according to the embodiment of the present invention.
Figure 2:
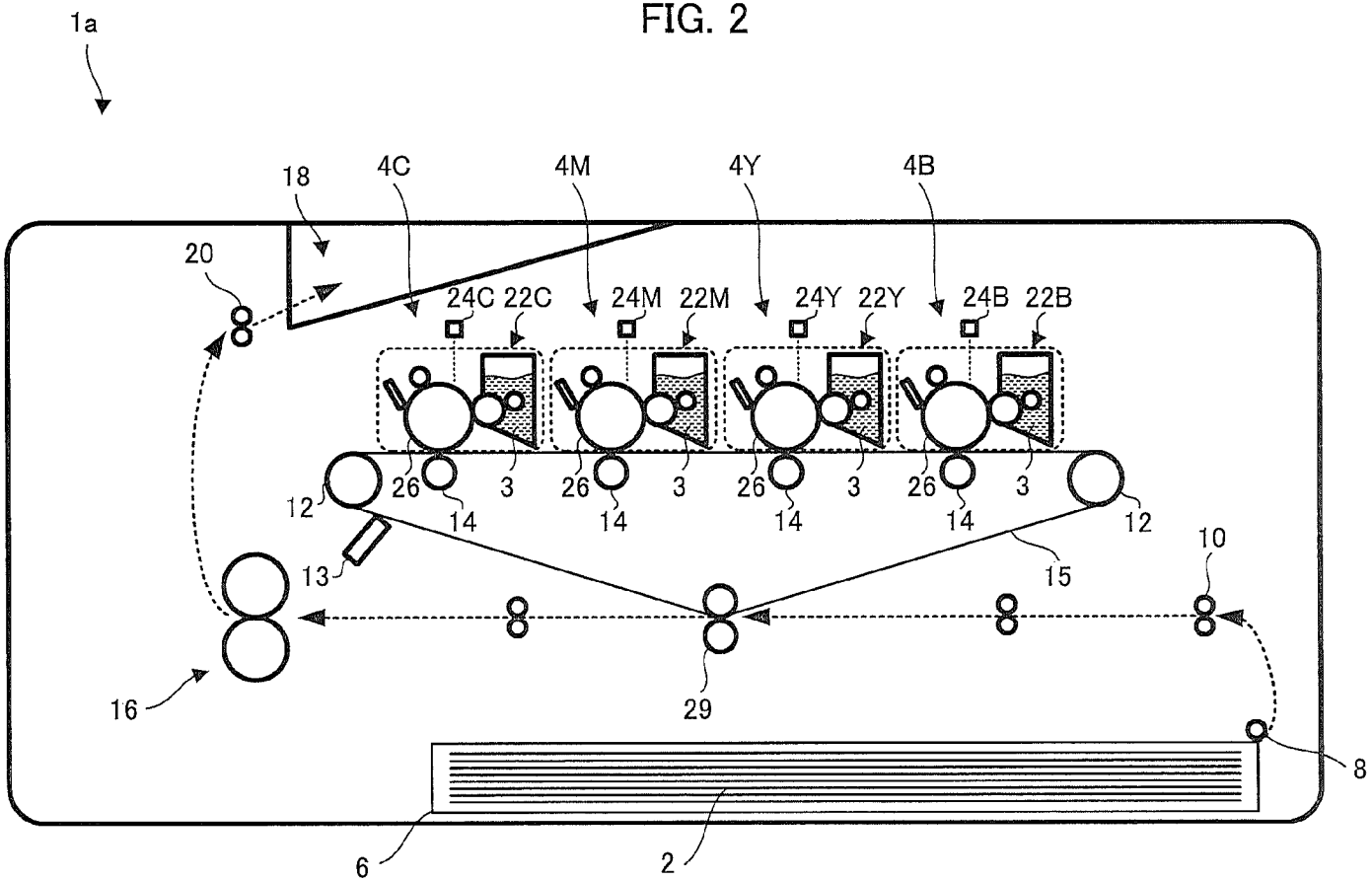
FIG. 2 is a cross-sectional view schematically showing a modification example of the image forming apparatus where an intermediate transfer belt is used as a transfer unit in the image forming apparatus shown in FIG. 1.

FIG. 1 is a cross-sectional view schematically showing internal structure of an image forming apparatus 1 according to the embodiment of the present invention. FIG. 2 is a cross-sectional view schematically showing a modification example of an image forming apparatus 1*a* where an intermediate transfer belt 15 is used as a transfer unit in the image forming apparatus 1 shown in FIG. 1. In FIG. 2, elements that are the same as or correspond to those in FIG. 1 are assigned the same numerals or symbols as those in FIG. 1. The image forming apparatus 1 is an electrophotographic color printer, for example. As shown in FIG. 1, the image forming apparatus 1 includes image forming sections 4B, 4Y, 4M and 4C, a paper feed unit 6, a paper feed roller 8, conveying rollers 10, a conveying member 11, drive rollers 12, a cleaning blade 13, transfer rollers 14, a fixing unit 16, and a paper ejection section 18. The image forming sections 4B, 4Y, 4M and 4C electrophotographically form a toner image on paper 2 as a recording medium by using toner 3 as developers. The paper feed unit 6 supplies the paper 2 to the image forming sections 4B, 4Y, 4M and 4C. The paper feed roller 8 feeds each sheet of the paper 2 one by one from the paper feed unit 6. The conveying rollers 10 carry the fed sheet of paper in a paper conveying direction. The conveying member 11 carries each sheet of the paper 2 fed by the conveying rollers 10 further to the image forming sections 4B, 4Y, 4M and 4C. The drive rollers 12 drive the conveying member 11. The cleaning blade 13 removes the toner 3 remaining on the conveying member 11. The transfer rollers 14 as transfer units are disposed at respective positions corresponding to the image forming sections 4B, 4Y, 4M and 4C. The fixing unit 16 fixes a transferred toner image onto each sheet of the paper 2. The paper ejection section 18 has paper ejecting rollers 20 which eject each sheet of the paper 2 that has passed through the fixing unit 16 to the outside of the image forming apparatus 1. As the conveying member 11, a conveying belt which is an endless belt can be used, for example. FIG. 1 shows the four image forming sections 4B, 4Y, 4M and 4C, but the number of the image forming sections included in the image forming apparatus 1 may be three or less or may be five or more. The image forming apparatus 1 shown in FIG. 1 is a color printer, but the present invention can be applied also to black-and-white printers having a single image forming section if they are electrophotographic image forming apparatuses for forming an image on a recording medium. The image forming apparatus 1 shown in FIG. 1 is a printer, but the present invention can be applied also to photocopiers, facsimile apparatuses, multifunction peripherals (MFPs), and other apparatuses if they are electrophotographic image forming apparatuses for forming an image on a recording medium.

The image forming sections 4B, 4Y, 4M and 4C form a black toner image, a yellow toner image, a magenta toner image, and a cyan toner image respectively, on each sheet of the paper 2. The image forming sections 4B, 4Y, 4M and 4C are arranged in order of the paper conveyance path, that is, in order from upstream to downstream of the paper conveyance path. The arrangement order of the image forming sections 4B, 4Y, 4M and 4C is not limited to that shown in FIG. 1. The image forming sections 4B, 4Y, 4M and 4C include image forming units 22B, 22Y, 22M and 22C respectively. The image forming units 22B, 22Y, 22M and 22C are detachable units for the respective colors. The image forming units 22B, 22Y, 22M and 22C are arranged on the paper conveyance path corresponding to the respective colors for the image forming sections 4B, 4Y, 4M and 4C. The image forming unit 22B forms an image with the toner 3 of black (B); the image forming unit 22Y forms an image with the toner 3 of yellow (Y); the image forming unit 22M forms an image with the toner 3 of magenta (M); and the image forming unit 22C forms an image with the toner 3 of cyan (C). The image forming units 22B, 22Y, 22M and 22C are basically the same in structure, except that the colors of the toner 3 are different. The image forming sections 4B, 4Y, 4M and 4C respectively have LED heads (i.e., LED array heads) 24B, 24Y, 24M and 24C, which function as exposing units. The configuration is not limited to the configuration that the exposing units are separate sections corresponding to the respective colors of the image forming sections 4B, 4Y, 4M and 4C. The exposing units may be integrally configured as a single unit. Each of the LED heads 24B, 24Y, 24M and 24C irradiates with light a photosensitive drum 26, which functions as an image carrier, in accordance with color image data input from a host device such as a computer. In the present embodiment, the image forming apparatus 1 shown in FIG. 1 will be mainly described, however, the present invention is not limited to the image forming apparatus 1. The present invention can be also applied to another image forming apparatus la shown in FIG. 2, in which the primary transfer rollers 14 transfer a visualized developer image onto the intermediate transfer belt 15 and then secondary transfer rollers 29 transfer the transferred developer image onto each sheet of the paper 2. The present invention can be also applied to a monochrome image forming apparatus, or a multicolor image forming apparatus that uses two or three color developers or more than four color developers.

Figure 3:
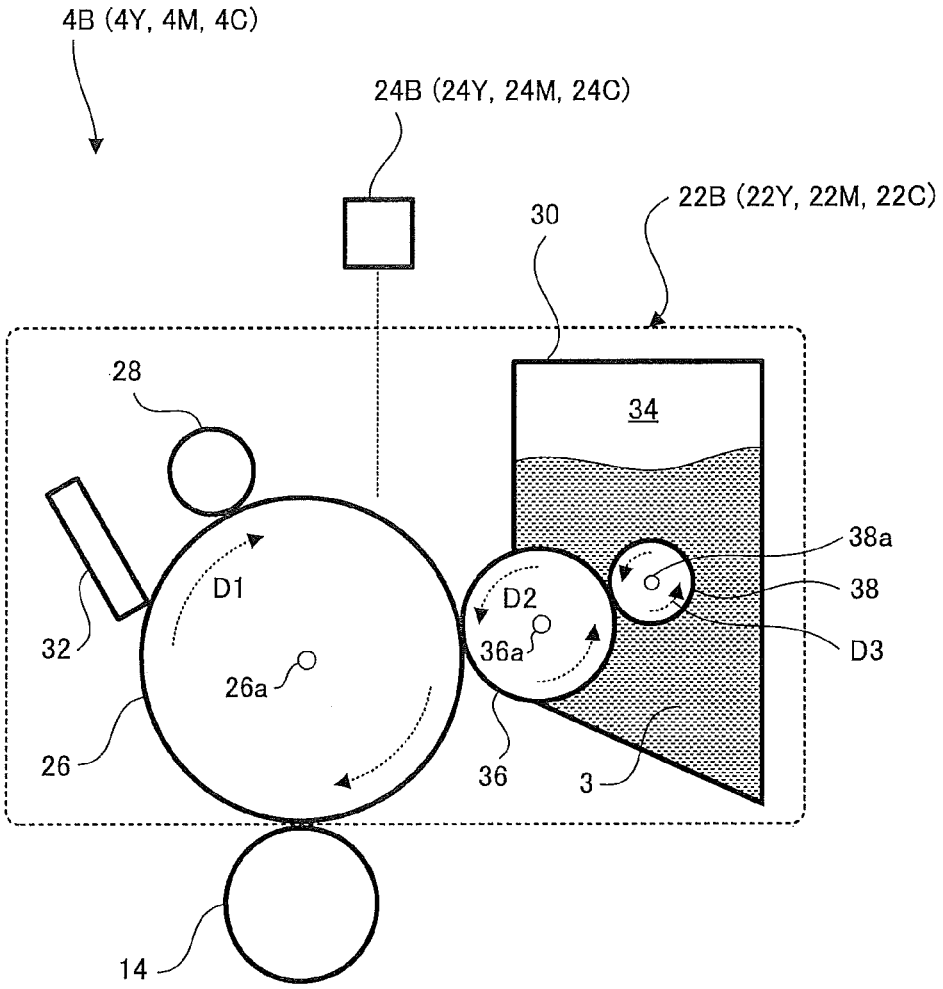
FIG. 3 is a cross-sectional view schematically showing structure of one of image forming sections shown in FIG. 1.

FIG. 3 is a cross-sectional view schematically showing the structure of one of the image forming sections 4B, 4Y, 4M and 4C shown in FIG. 1. As shown in FIG. 3, each of the image forming sections 4B, 4Y, 4M and 4C includes the photosensitive drum 26, a charging roller 28, one of the LED heads 24B, 24Y, 24M and 24C, a developing unit 30, the transfer roller 14, and a cleaning member 32. The photosensitive drum 26 as the image carrier is rotatably supported about a rotation center shaft 26*a*. The charging roller 28 as a charging member electrically charges an outer surface of the photosensitive drum 26 uniformly. Each of the LED heads 24B, 24Y, 24M and 24C is a light source used for forming an electrostatic latent image on the outer surface of the photosensitive drum 26. The photosensitive drum 26 is exposed with light from each of the LED heads 24B, 24Y, 24M and 24C, and thus the electrostatic latent image is formed on the surface of each of the photosensitive drums 26. The developing unit 30 as a developing section supplies the toner 3 onto the outer surface of the photosensitive drum 26 to form a toner image corresponding to the electrostatic latent image. The transfer roller 14 as the transfer unit transfers the toner image formed on the outer surface of the photosensitive drum 26 onto each sheet of the paper 2. The cleaning member 32 cleans the outer surface of the photosensitive drum 26. As the cleaning member 32, a blade-shaped member can be used, for example. The cleaning member 32 removes a residual toner or the like from the outer surface of the photosensitive drum 26 by touching the outer surface of the photosensitive drum 26.

The photosensitive drum 26 has a cylindrical shape and includes a conductive base and a photoconductive layer. The photoconductive layer is provided around an outer surface of the conductive base. The conductive base of the photosensitive drum 26 can be made of a metal such as aluminum, for example. The photosensitive drum 26 rotates on the rotation center shaft 26*a* in a direction D1 by driving force produced by a driving unit such as a motor. It is desirable that the outer diameter of the photosensitive drum 26 should be 30 mm or so.

The charging roller 28 includes a rod-shaped conductive base and a semiconductive rubber layer covering the outer circumference of the conductive base. The conductive base of the charging roller 28 may be made of a metal such as aluminum, and the semiconductive rubber layer of the charging roller 28 may be made of epichlorohydrin rubber or the like. The outer surface of the photosensitive drum 26 can be charged by making the charging roller 28 touch the outer surface of the photosensitive drum 26. However, it is not limited to this manner, non-contact charging is also possible, that is, the outer surface of the photosensitive drum 26 may be charged by the charging roller 28 that is not in contact with the photosensitive drum 26. The charging member is not limited to a roller-shaped member, and it may be a charging wire which is a wire-shaped member. In a case where the charging wire is used as the charging member, the outer surface of the photosensitive drum 26 is charged by discharge of electricity from the charging wire.

The cleaning member 32 scrapes off the toner 3 remaining on the outer surface of the rotating photosensitive drum 26 and other residuals such as external additives detached from the toner 3. As the cleaning member 32, a rectangular-shaped rubber blade made of urethane rubber can be used, for example. The cleaning member 32 is not limited to the blade-shaped member, and a member of any shape, like a brush-like member, can be used if it can scrape off residuals such as the residual toner and external additives.

(Developing Unit 30)

As shown in FIG. 3, the developing unit 30 includes a toner container 34, a developing roller 36, and a supply roller 38. The toner container 34 as a developer containing section forms a room for containing the toner 3 as a developer. The developing roller 36 as a developer carrier supplies the toner 3 onto the outer surface of the photosensitive drum 26. The supply roller 38 as a developer supplying member supplies the toner 3 contained in the toner container 34 to the developing roller 36.

The toner container 34 is provided for each of the image forming sections 4B, 4Y, 4M and 4C. The color of the toner in the toner container 34 corresponds to the color of the image forming section, that is, in the image forming unit 22B, the toner container 34 stores black (B) toner; in the image forming unit 22Y, the toner container 34 stores yellow (Y) toner; in the image forming unit 22M, the toner container 34 stores magenta (M) toner; and in the image forming unit 22C, the toner container 34 stores cyan (C) toner. The toner 3 has an average grain diameter of 6.5 μm to 8.0 μm, and its main constituent is a styrene-acryl copolymer.

The developing roller 36 as the developer carrier and the supply roller 38 are disposed in the toner container 34. The developing roller 36 touches the photosensitive drum 26. The supply roller 38 supplies the toner 3 onto the developing roller 36.

(Developing Roller 36)

The developing roller 36 supplies the toner 3 to an electrostatic latent image on the photosensitive drum 26 to develop the electrostatic latent image so that a toner image is formed on the photosensitive drum 26. The developing roller 36 is disposed in contact with the photosensitive drum 26. The developing roller 36 and the photosensitive drum 26 rotate in opposite directions D2 and D1 of rotation respectively. Therefore, the developing roller 36 and the photosensitive drum 26 move in the same direction (in a downward direction in FIG. 3) on a tangent line between them.

Figure 4:
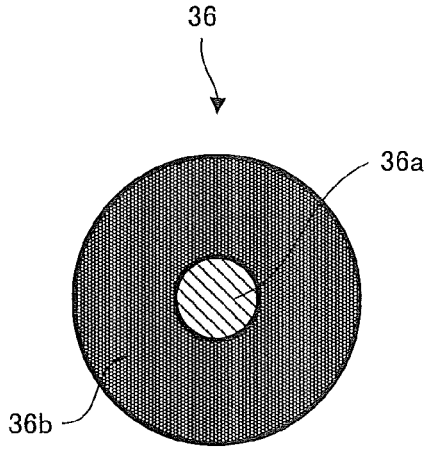
FIG. 4 is a cross-sectional view schematically showing a developing roller according to the embodiment of the present invention.

FIG. 4 is a cross-sectional view schematically showing the developing roller 36 in the present embodiment. The developing roller 36 includes a conductive developing-roller support member 36*a* which is a rotation shaft, and a developing-roller elastic layer 36*b* which is disposed on the outer circumference of the conductive developing-roller support member 36*a*. The developing roller 36 is rotatably supported. In the present embodiment, it is desirable that the developing roller 36 should have a cylindrical shape, and its outer diameter should be approximately 15.9 mm. The developing-roller support member 36*a* is rod-shaped and can be made of a metal such as aluminum. The developing-roller elastic layer 36*b* is mainly composed of urethane and has hardness of 77±5 degrees measured by using an Asker C type durometer. A peripheral speed of the developing roller 36 is approximately 239.8 mm/second. In the present embodiment, the peripheral speed of the developing roller 36 is a linear velocity in a tangential direction of the surface of the developing roller 36.

(Supply Roller 38)

Figure 5A:
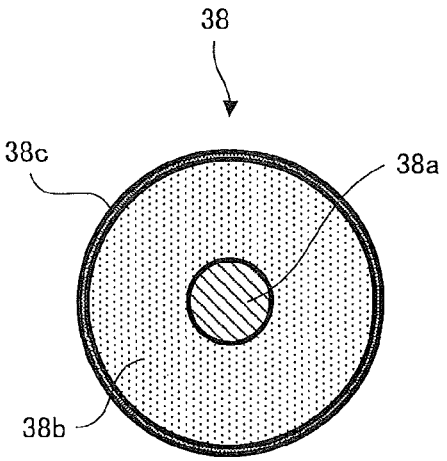
FIG. 5A is a cross-sectional view schematically showing a supply roller according to the embodiment of the present invention.
Figure 5B:
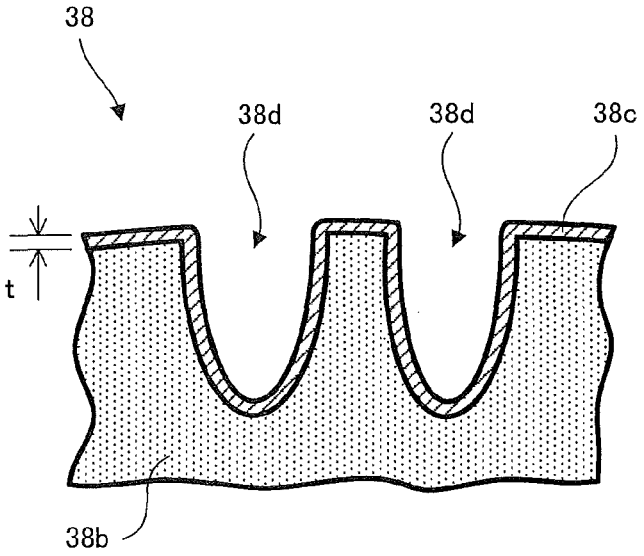
FIG. 5B is an enlarged cross-sectional view schematically showing the supply roller near its outer surface.

FIG. 5A is a cross-sectional view schematically showing the supply roller 38 in the present embodiment. FIG. 5B is an enlarged cross-sectional view schematically showing the supply roller 38 near its outer surface. The supply roller 38 includes a conductive supply-roller support member 38*a* which is a rotation shaft, and a supply-roller elastic layer 38*b* as a base material (i.e., a base material layer) disposed on an outer surface of the supply-roller support member 38*a*. The supply roller 38 is rotatably supported on the developing unit 30. In the present embodiment, the supply roller 38 and the developing roller 36 rotate in the same direction D3 and D2 of rotation respectively. Therefore, the supply roller 38 and the developing roller 36 moves in opposite directions (a downward direction and an upward direction in FIG. 3) on a tangent line between the supply roller 38 and the developing roller 36. It is possible, however, to rotate the supply roller 38 and the developing roller 36 in opposite directions of rotation to each other, that is, to rotate the supply roller 38 and the developing roller 36 so as to move in the same direction on the tangent line between them. The supply-roller support member 38*a* is a rod-shaped member and can be made of a metal such as aluminum. The supply roller 38 in the present embodiment has a cylindrical shape, and its outer diameter is approximately 15.5 mm. If the outer diameter of the developing roller 36 ranges from 15 mm to 21 mm, it is desirable that the outer diameter of the supply roller 38 should range from 15 mm to 16 mm.

The supply-roller elastic layer 38*b* is formed to have closed-cell foam structure, that is, sponge structure containing closed-cell foams 38*d*. It is desirable that the closed-cell foams 38*d* should have cell (foam) diameters which range from 50 μm to 300 μm, and its average cell diameter should range from 80 μm to 120 μm. The cell diameter was measured by a laser microscope VK-8500 manufactured by Keyence Corporation. The supply-roller elastic layer 38*b* is made by mixing conductive materials so as to have a partial resistance of $1\times10^6\ \Omega$ to $1\times10^8\ \Omega$. The shape and size of the supply roller 38 are not limited to those in the present embodiment.

The supply roller 38 is disposed in such a position that its surface comes in contact with a surface of the developing roller 36. It is desirable that the developing roller 36 and the supply roller 38 be disposed with an axis-to-axis distance of 14.7 mm. A peripheral speed of the supply roller 38 is set to 0.85 times a peripheral speed of the developing roller 36. In the present embodiment, the peripheral speed of the supply roller 38 is a linear velocity in a tangential direction of the surface of the supply roller 38. The peripheral speed ratio of the supply roller 38 to the developing roller 36 is not limited to the value in the present embodiment.

The supply-roller elastic layer 38*b* is made of a material containing an elastomer composition and has the closed-cell foam structure, that is, the sponge structure containing closed-cell foams 38*d*. By using the supply roller 38 which has the closed-cell foam structure, that is, the sponge structure containing the closed-cell foams 38*d*, the toner 3 can be uniformly supplied to the developing roller 36. Moreover, it is easy to scrape off the toner 3 remaining on the outer surface of the developing roller 36 after the toner 3 is supplied from the developing roller 36 to the outer surface of the photosensitive drum 26. Furthermore, the toner 3 can be uniformly charged as a result of friction caused in the toner 3 surrounding the supply roller 38, and a toner image with uniform density can be formed on the photosensitive drum 26.

A base material used for the supply roller 38 contains silicone rubber as a main constituent and an ethylene-propylene-diene rubber or the like as sub constituents. The main constituent of the base material may be urethane with high abrasion resistance, instead of silicone rubber. The sub constituent of the base material may be replaced by a base material with one or more of the following substances added: polyurethane, butyl rubber, polyisoprene rubber, polybutadiene rubber, styrene-butadiene rubber, ethylene-propylene rubber, acrylic rubber and the like. The main constituent in the present embodiment is a constituent, the content of which is not less than 50 wt %.

The supply-roller elastic layer 38*b* contains, as fillers, the following substances: filler agents such as fumed silica, precipitated silica and reinforcing carbon black; conductive carbon black; metal powder such as nickel, aluminum and copper; a metallic oxide such as zinc oxide; conductive fillers made by coating with tin oxide a core material such as barium sulfate, titanium oxide and potassium titanate; and the like. As a blowing (foaming) agent to form the closed-cell foam structure, that is, the sponge structure containing the closed-cell foams 38*d*, an agent based on an azo compound is used in the present embodiment. As a substitute, at least one type of blowing agents based on a bicarbonate, isocyanate, nitrite, hydrazine derivative and azide compound may be used. As a cross-linking agent, a peroxide agent and a sulfur-based vulcanizing agent are used in the present embodiment. As a substitute, a hydrogen siloxane in the presence of a platinum-based catalyst, an isocyanate agent, or other agents may be used.

If hardness (hardness measured by an Asker F type durometer, for example) of the base material is low, a problem may be caused: when the supply roller 38 touches the developing roller 36, stress on the surface of the supply roller 38 is reduced, the supply roller 38 cannot touch the developing roller 36 with an appropriate pressure, and it causes density variation on printed sheets, that is, printed images are different in density on every sheet. The density variation is found in an upper part and a lower part of a printed image printed on each sheet of the paper 2.

To cope with the problem, the supply roller 38 in the present embodiment has a coating film 38*c*, which is a polymer membrane, for example. As shown in FIG. 5B, the coating film 38*c* is formed as a surface film of the supply roller 38, that is, the surface of the supply-roller elastic layer 38*b*. In the present embodiment, 'the coating film 38*c*' is referred to as a film formed on the surface of the supply-roller elastic layer 38*b*, which is the base material. The coating film 38*c* is formed so as to cover also the inner surface of an open-cell foam on the surface of the supply-roller elastic layer 38*b*. With the coating film 38*c* formed on the surface of the supply roller 38, when the supply roller 38 touches the developing roller 36, the stress relaxation on the surface of the supply roller 38 progresses more slowly, and the supply roller 38 can touch the developing roller 36 with an appropriate pressure between them. This makes it possible to supply an appropriate amount of the toner 3 from the supply roller 38 to the developing roller 36, and thus printed images of high quality can be obtained.

During an image forming process, the supply roller 38 touches the developing roller 36 and they rub against each other. While the image forming process is repeated, when the outermost surface of the supply roller 38 expands and shrinks, stress is concentrated on the fillers and the like which are exposed on the surface of the supply roller 38. Consequently, the exposed fillers and base material are broken, and the supply roller 38 is worn. Such wear of the supply roller 38 is likely to occur in a case where the hardness of the supply roller 38 is lower than the hardness of the developing roller 36.

To cope with the problem, the supply roller 38 in the present embodiment has the coating film 38*c* formed on its surface, that is, on the surface of the supply-roller elastic layer 38*b*. By forming the coating film 38*c* as the surface film of the supply roller 38, it is possible to reduce the concentration of stress on the fillers and the like exposed on the surface of the supply-roller elastic layer 38*b*, and thereby reduce the wear caused by that the supply roller 38 rubs against the developing roller 36. Thus, it is possible to maintain high-quality image forming for a longer time.

The supply roller 38 in the present embodiment is made in the following manner. The supply-roller elastic layer 38*b* is formed to surround the supply-roller support member 38*a*. The surface of the supply-roller elastic layer 38*b* is polished so that the supply roller 38 has the outer diameter of 15.5 mm, for example. The base material is soaked in a solution which includes a silicon resin as a main constituent, and then heat is applied to the surface of the base material to harden it. The coating film 38*c* may be formed to have an arbitrary thickness in the range of 0.1 μm to 10 μm by adjusting the concentration of the solution. It is desirable that hardness of the coating film 38*c* should be uniform.

As the thickness of the coating film 38*c* increases, the hardness of the surface of the supply roller 38 increases. Accordingly, if the hardness of the surface of the supply roller 38 is high, the surface of the supply roller 38 is still hard even if the supply-roller elastic layer 38*b* is dented, and the supply roller 38 excessively scrapes the surface of the developing roller 36. If the surface of the developing roller 36 is excessively scraped, a developer supply ability to supply the developer to the developing roller 36 is lowered, the amount of the toner supplied to the developing roller 36 decreases, and faint print appears in printed images as a result. The supply roller 38 performs two functions: to supply the toner 3 to the developing roller 36 and to scrape off the toner 3 from the developing roller 36. An imbalance between the two functions causes such faint print. Moreover, if the hardness of the surface of the supply roller 38 is too high, the surface of the developing roller 36 is worn.

If the hardness of the supply roller 38 is low, the supply roller 38 is dented when it touches the surface of the developing roller 36, and the stress is reduced on the surface of the supply roller 38. This makes it impossible for the supply roller 38 to touch the developing roller 36 with an appropriate pressure, and the developer supply ability is lowered. For this reason, in order to maintain the developer supply ability of the supply roller 38, the supply roller 38 needs such a level of hardness that the surface of the supply roller 38 is not dented. In the present embodiment, 'faint print' (also referred to as 'image unevenness') refers to unevenness occurring in a printed image when a solid image is faintly printed on paper.

An experiment described below was carried out for determining an appropriate range of a combination of the thickness of the coating film 38*c* on the surface of the supply-roller elastic layer 38*b* and the hardness of the supply-roller elastic layer 38*b*. In the present embodiment, 'the thickness of the coating film 38*c*' refers to a thickness (t) of the film which covers the surface of the supply-roller elastic layer 38*b*, including the inner surfaces of the open cells on the surface of the supply-roller elastic layer 38*b*, as shown in FIG. 5B.

(Operation of Image Forming Apparatus 1)

According to a print instruction sent from an external device such as a computer, the print instruction is input to a controller as a control unit in the image forming apparatus 1. Then, in each of the image forming sections 4B, 4Y, 4M and 4C, the photosensitive drum 26, developing roller 36 and supply roller 38 start rotating by driving force produced by the drive unit such as the motor controlled by the controller. The charging roller 28 is rotated by following the rotation of the photosensitive drum 26. When each sheet of the paper 2 is sent by the paper feed roller 8 of the paper feed unit 6, the controller applies a charge voltage to the charging roller 28. In accordance with the image data input to the controller of the image forming apparatus 1, in each of the image forming sections 4B, 4Y, 4M and 4C, the charging roller 28 charges the outer surface of the photosensitive drum 26, the charged photosensitive drum 26 is exposed to light emitted from each of the LED heads 24B, 24Y, 24M and 24C, an electrostatic latent image is formed on the outer surface of the photosensitive drum 26, and thus the developing unit 30 forms a toner image corresponding to the electrostatic latent image.

Each sheet of the paper 2 fed from the paper feed unit 6 is carried by the pair of conveying rollers 10 to transfer positions in the respective transfer units of the image forming sections 4B, 4Y, 4M and 4C. The toner image formed on the outer surface of the photosensitive drum 26 is transferred onto each sheet of the paper 2 at the moment it passes the transfer position. Each sheet of the paper 2 on which the toner images are transferred is carried to the fixing unit 16, where the toner images are fixed onto each sheet of the paper 2 by applying heat and pressure. Each sheet of the paper 2 on which the images are fixed is carried by the paper ejecting rollers 20 in a direction in which the paper 2 is ejected, and is then ejected to the paper ejection section 18.

(Measurement and Test of Supply Roller 38)

Twelve different samples A, B, C, D, E, F, G, H, I, J, K and L of the supply roller 38 were created, and their properties were measured. The samples were also subjected to a continuous print test. The property measurement and continuous print test of the samples were carried out under a temperature of 25±1° C. and a humidity of 55±5%.

(Samples)

Table 1 shows values of thicknesses (average film thickness) of the coating films 38*c* and hardness (Asker F hardness) of base materials of samples A to L of the supply roller 38 used in the continuous print test. The 'Asker F hardness' refers to a hardness value measured by using an Asker F type durometer. Samples A to C were samples of the supply roller 38 without the coating film formed on the surface of the supply-roller elastic layer 38*b*. Base materials of samples A, B and C had hardness of 48 degrees, 57 degrees and 62 degrees respectively. Samples D, E and F were made by forming, on base materials of sample A, the coating films 38*c* of 0.75 μm, 1.5 μm and 3.0 μm in thickness respectively. Samples D, E and F had hardness of 52 degrees, 54 degrees and 55 degrees respectively. Samples G, H and I were made by forming, on base materials of sample B, the coating films 38*c* of 0.75 μm, 1.5 μm and 3.0 μm in thickness respectively. Samples G, H and I had hardness of 59 degrees, 61 degrees and 63 degrees respectively. Samples J, K and L were made by forming, on base materials of sample C, the coating films 38*c* of 0.75 μm, 1.5 μm and 3.0 μm in thickness respectively. Samples J, K and L had hardness of 63 degrees, 65 degrees and 69 degrees respectively. Fillers added to each of the samples are the same in amount. The thickness of the coating film 38*c* can be measured by observing a cross-section of a part taken from an outermost surface of the supply roller 38, by using a scanning electron microscope, laser microscope or the like.

In the present embodiment, a value of 'average film thickness' of the coating film in each of samples A to L was obtained by averaging values measured at three points at least by using a laser microscope VK-8500 manufactured by Keyence Corporation. The 'hardness' of samples A to C is Asker F hardness of the supply roller 38 without the coating film 38*c* formed on its surface. The 'hardness' of samples D to L is Asker F hardness of the supply roller 38 with the coating film 38*c* formed on its surface. Values of 'compressive spring constant' in Table 1 were measured with respect to samples A to L by using a jig under a given condition.

TABLE 1

| Sample | Average film thickness (μm) | Asker F hardness (degrees) | Compressive spring constant ($kN/m^2$) |
|---|---|---|---|
| A | — | 48 | 30.7 |
| B | — | 57 | 51.3 |
| C | — | 62 | 57.0 |
| D | 0.75 | 52 | 35.4 |
| E | 1.5 | 54 | 33.3 |
| F | 3.0 | 55 | 34.4 |
| G | 0.75 | 59 | 42 |
| H | 1.5 | 61 | 41.5 |
| I | 3.0 | 63 | 45.4 |
| J | 0.75 | 63 | 56.6 |
| K | 1.5 | 65 | 55.3 |
| L | 3.0 | 69 | 62.3 |

The hardness of the base materials of samples A to L was adjusted by varying the amounts of a cross-linking agent and a blowing agent added to the base materials. If the Asker F hardness of the base material is lower than 48 degrees, the amount of the toner 3 to be supplied increases, but it is difficult for the supply roller 38 to scrape off the toner 3 having an electrical charge from the surface of the developing roller 36. In this case, image quality sometimes deteriorates due to an afterimage caused by the supply roller 38. On the other hand, if the Asker F hardness of the base material is higher than 62 degrees, the supply roller 38 strongly scrapes the toner 3 from the surface of the developing roller 36 and an afterimage rarely occurs. As the Asker F hardness of the base material increases, however, the abrasion loss of the supply roller 38 caused by that the supply roller 38 rubs against the developing roller 36 increases, an available resistance range of the supply roller 38 is narrowed, and accordingly it is difficult to control by voltage.

Samples A to C in the present embodiment were prepared so that the hardness (Asker F hardness) of the base materials ranges from 48 degrees to 62 degrees. Samples D to L were created so as to satisfy the following equations (1) to (3):

$$SP2=A\times SP1+B \quad (1)$$

$$A=0.11\times M+0.84 \quad (2)$$

$$B=-0.984\times M^2-0.43\times M+8.75 \quad (3)$$

where SP2 is the Asker F hardness of the supply roller 38, SP1 is the Asker F hardness of the base material, and M is the average film thickness, after forming of the coating film 38*c* on the supply roller 38 of sample A, B or C. In equation (3), the average film thickness M was adjusted to be 0.75 μm, 1.5 μm or 3.0 μm.

(Details of Continuous Print Test)

The continuous print test was carried out for evaluating the functionality of the supply roller 38, by printing an image with coverage of 0.3%, as image 'A' for continuous printing use, in respective entire printable areas on 40,000 A4 sheets. Then, faint print and density of printed images were evaluated. In the process of printing 40,000 sheets, images 'B' and 'C' for evaluation use were printed each time 1,000 sheets were printed. By using images 'B' and 'C' printed at the beginning of the test and images 'B' and 'C' printed at the end of the test, the faint print evaluation and density evaluation were performed.

In the continuous print test, the outer diameters of the photosensitive drum 26, the developing roller 36 and the supply roller 38 were set to approximately 30 mm, 15.9 mm and 15.5 mm respectively. The developing unit 30, in which each of samples A to L as the supply roller 38 was incorporated, was used in the test. A peripheral speed of the developing roller 36 was 239.8 mm/second. The print test was carried out, by applying voltages of approximately −130 volts, approximately −260 volts and approximately −1000 volts to the developing roller 36, the supply roller 38 and the charging member respectively, which were main components of the image forming apparatus 1.

(Faint Print Evaluation)

Figure 6:
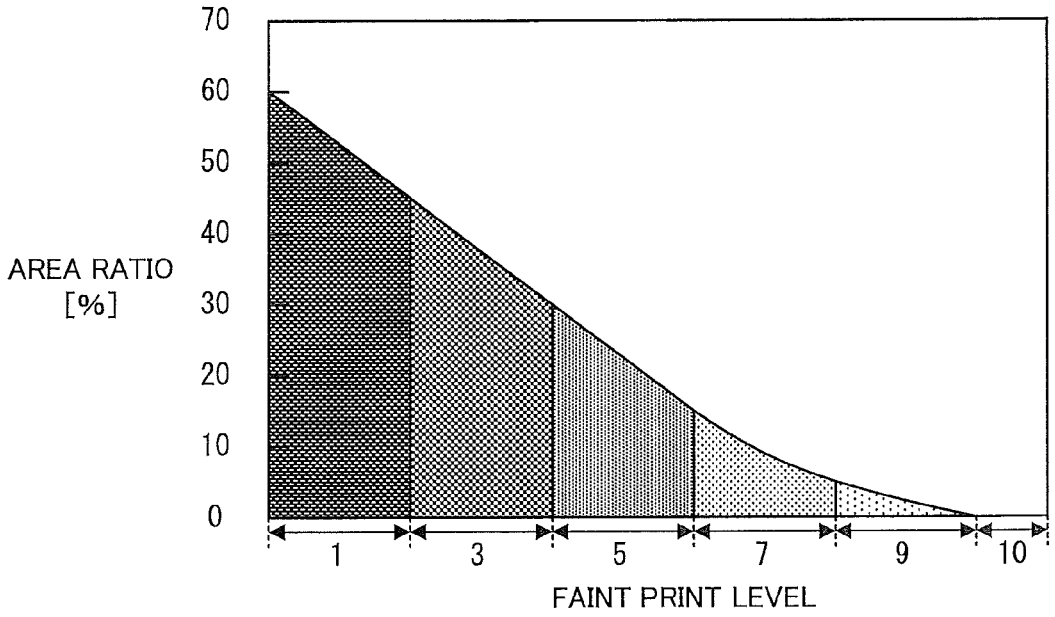
FIG. 6 is a diagram showing a relationship between ratios (%) of area of a faintly-printed part and values of faint print evaluation levels (faint print levels) set in relation to the ratios, in faint print evaluation.

The faint print evaluation was performed by using image 'B' for evaluation use printed at the end of the continuous print test. Image 'B' was a solid image with coverage of 100%. The faint print evaluation was made by observing a faintly-printed part (where the developer is insufficiently supplied) in the printed image and determining a ratio of area of the faintly-printed part. FIG. 6 is a diagram showing a relationship between the ratios (%) of area of the faintly-printed part and values of faint print evaluation levels (i.e., faint print levels) which were set in relation to the ratios of area. As shown in FIG. 6, the evaluation levels range from levels 1 to 10. Level 1 was a lowest level and level 10 was a highest level. Levels 6 to 10 were defined as satisfactory levels. If the ratio of area of the faintly-printed part to an entire printable area was 0%, it was determined as level 10; if the ratio was more than 0% and less than 5%, it was determined as level 9; if the ratio was 5% or more and less than 15%, it was determined as level 7; if the ratio was 15% or more and less than 30%, it was determined as level 5; if the ratio was 30% or more and less than 45%, it was determined as level 3; if the ratio was 45% or more and less than 60%, it was determined as level 1. The density was measured at three points chosen at random from the faintly-printed part and a well-printed part, a variation in the measured density was calculated, and the evaluation level was adjusted by taking the density variation into consideration. Specifically, if the density variation was not more than 0.2 (OD: Optical Density), the evaluation level was left unchanged; if the density variation was more than 0.2 (OD) and not more than 0.4 (OD), the evaluation level was given an increment of −0.5; if the density variation was more than 0.4 (OD) and not more than 0.6 (OD), the evaluation level was given an increment of −1; if the density variation was more than 0.6 (OD), the evaluation level was given an increment of −1.5. Thus, a final evaluation level was determined.

(Image Density Evaluation)

The image density evaluation was performed by using image C for evaluation use printed at the beginning and end of the continuous print test. Image 'C' was a solid image with coverage of 100%. The density was measured at three arbitrary points 30 mm distant from an upper end of the printed image, an average value of the measured density was determined, and the obtained average value was defined as upper density. The density was measured at three arbitrary points 30 mm distant from a lower end of the printed image, an average value of the measured density was determined, and the obtained average value was defined as lower density. The density was measured by using X-Rite 528 manufactured by X-Rite, Incorporated.

(Measurement of Abrasion Loss)

Before and after the continuous print test, the outer diameter of the supply roller 38 was measured. A difference obtained as a result of the measurement was defined as abrasion loss.

Figure 8:
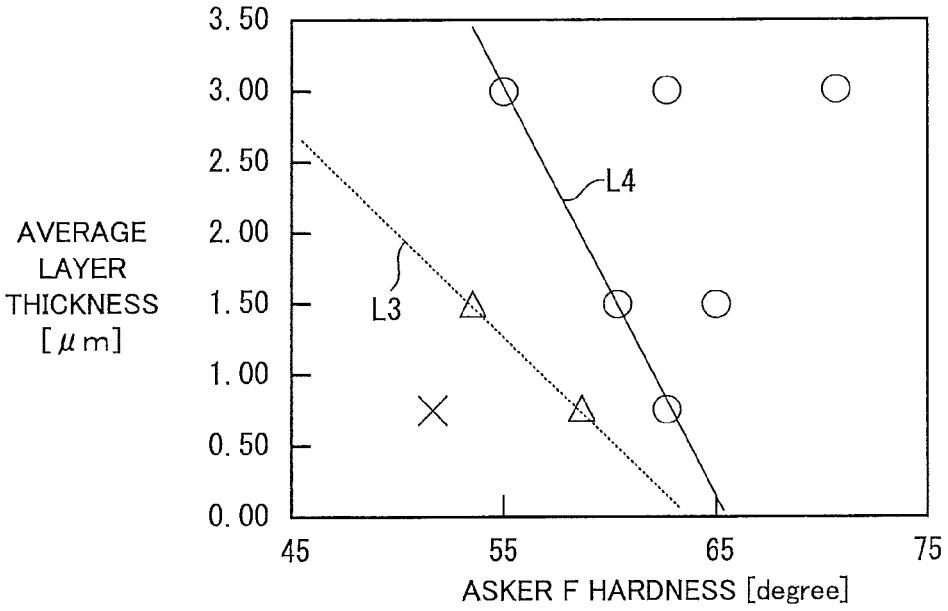
FIG. 8 is a diagram showing a relationship between a thickness (average film thickness) and hardness (Asker F hardness) of the coating film, based on a result of image density evaluation.

Table 2 shows a result of the faint print evaluation. Table 3 shows a result of the image density evaluation. In Table 3, upper density 1 and lower density 1 indicate density in the image printed at the beginning of the continuous print test; upper density 2 and lower density 2 indicate density in the image printed at the end of the continuous print test; an upper density variation indicates a difference between upper density 1 and upper density 2; a lower density variation indicates a difference between lower density 1 and lower density 2. From the result of the image density evaluation shown in Table 3, it is found that values of the lower density variations are larger than values of the upper density variations in all the samples. One conceivable reason is that: the developer supplying function and developer scraping function of the developer supply member appropriately work at the upper part of the printed area, however, as printing proceeds downward in the printed area, these functions deteriorate and ability to supply the developer to the developer carrier is lowered. In order to maintain high-quality print image density in the electrophotographic image forming process, the developer supply member should maintain the developer supplying function and developer scraping function, in other words, the developer supply member should stably supply the developer to the developer carrier and scrape off the residual developer (residual charge) remaining on the developer carrier. However, the developer supply member repeatedly rubs against the developer carrier, and the surface of the developer supply member is accordingly worn. Moreover, repetition of periodic stress deformation causes fatigue fracture of the developer supply member, and it may cause the hardness of the developer supply member to be lowered. If the hardness of the developer supply member is lowered, the developer cannot be sufficiently supplied to the developer carrier. Moreover, the residual developer (residual charge) cannot be sufficiently scraped off, and the residual charge remaining on the developer carrier prevents the developer from being supplied to the developer carrier. Accordingly, the amount of the developer supplied for printing the lower part of the printed area decreases. A remarkable difference is found between the upper density variation and the lower density variation when a solid image is printed in particular. It is considered that this is the reason why the values of the lower density variation are greater than the values of the upper density variation in all the samples, as shown in Table 3. Thus, out of the result of the image density evaluation, i.e., the upper density variation and lower density variation, shown in Table 3, as the lower density variation indicates a more remarkable difference, the values of the lower density variation were utilized as final evaluation data as shown in FIG. 8 described later.

Table 4 shows the difference in the outer diameter of the supply roller 38 before and after the continuous print test. As shown in Table 2, well-printed images were obtained with samples D to L having the coating films 38*c* formed on their surfaces. As shown in Table 3, the printed images printed with samples D to L were preferable especially with respect to the lower density variation. Moreover, as shown in Table 4, the abrasion loss of samples D to L with the coating films 38*c* was smaller than the abrasion loss of samples A to C without the coating films 38*c* formed on the surfaces of the supply rollers 38.

TABLE 2

| Sample | Faint print |
|---|---|
| A | 3 |
| B | 6.5 |
| C | 8.5 |
| D | 6.5 |
| E | 6 |
| F | 4 |
| G | 7.5 |
| H | 6.5 |
| I | 5 |

TABLE 2-continued

| Sample | Faint print |
|---|---|
| J | 8 |
| K | 7.5 |
| L | 6 |

TABLE 3

| Sample | Upper density 1 (OD) | Lower density 1 (OD) | Upper density 2 (OD) | Lower density 2 (OD) | Upper density variation (OD) | Lower density variation (OD) |
|---|---|---|---|---|---|---|
| A | 1.35 | 1.44 | 1.35 | 1.19 | 0.00 | 0.25 |
| B | 1.41 | 1.46 | 1.38 | 1.25 | 0.03 | 0.21 |
| C | 1.34 | 1.43 | 1.33 | 1.30 | 0.01 | 0.13 |
| D | 1.37 | 1.32 | 1.25 | 1.19 | 0.12 | 0.13 |
| E | 1.40 | 1.33 | 1.38 | 1.23 | 0.02 | 0.10 |
| F | 1.41 | 1.32 | 1.37 | 1.26 | 0.04 | 0.06 |
| G | 1.41 | 1.36 | 1.40 | 1.26 | 0.01 | 0.10 |
| H | 1.41 | 1.33 | 1.37 | 1.26 | 0.04 | 0.07 |
| I | 1.41 | 1.35 | 1.36 | 1.27 | 0.05 | 0.08 |
| J | 1.41 | 1.38 | 1.38 | 1.30 | 0.03 | 0.08 |
| K | 1.39 | 1.35 | 1.38 | 1.27 | 0.01 | 0.08 |
| L | 1.43 | 1.36 | 1.37 | 1.28 | 0.06 | 0.08 |

TABLE 4

| Sample | Abrasion loss (mm) |
|---|---|
| A | 0.29 |
| B | 0.32 |
| C | 0.30 |
| D | 0.19 |
| E | 0.19 |
| F | 0.18 |
| G | 0.20 |
| H | 0.17 |
| I | 0.18 |
| J | 0.21 |
| K | 0.19 |
| L | 0.18 |

Figure 7:
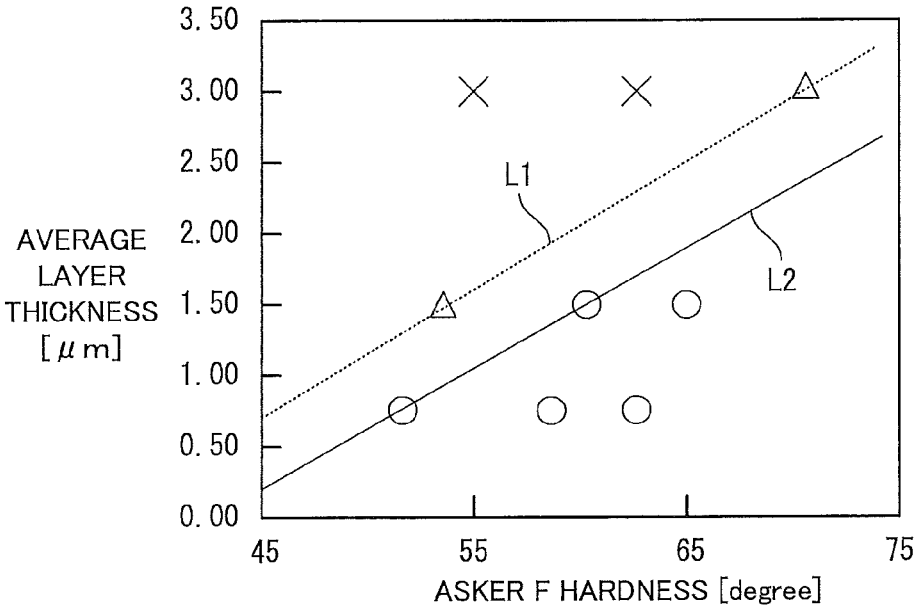
FIG. 7 is a diagram showing a relationship between a thickness (average film thickness) and hardness (Asker F hardness) of a coating film, based on a result of faint print evaluation.

FIG. 7 shows a relationship between the thickness (average thickness) of the coating film 38*c* and the hardness (Asker F hardness) of the supply roller 38, based on the result of the faint print evaluation shown in Table 2. In FIG. 7, with respect to the result of the faint print evaluation shown in Table 2, level 6 defined as a 'standard' level is represented by a triangle; levels 1 to 5 defined as 'poor' levels are represented by a cross; and levels 7 to 10 defined as 'good' levels are represented by a circle.

Line L1 in FIG. 7 is described by expression (4) given below, where T is the thickness (v) of the coating film 38*c* of the supply roller 38 and H is the Asker F hardness (degrees) of the supply roller 38. By using the supply roller 38 which satisfies the condition of expression (4), well-printed images can be obtained with less faint print.

$$T \leq 0.1 \times H - 3.9 \quad (4)$$

Line L2 in FIG. 7 is described by expression (5) given below. It is more preferable to use the supply roller 38 which satisfies the condition of expression (5). Better-printed images can be thereby obtained with further less faint print.

$$T \leq 0.08 \times H - 3.58 \quad (5)$$

FIG. 8 shows a relationship between the thickness (average thickness) of the coating film 38*c* and the hardness (Asker F hardness) of the supply roller 38, based on the result of the image density evaluation shown in Table 3.

With respect to the result of the image density evaluation shown in Table 3, if a value of the lower density variation is 0.1 (OD), it is evaluated as 'standard' and represented by a triangle in FIG. 8; if the value is larger than 0.1 (OD), it is evaluated as 'poor' and represented by a cross in FIG. 8; and if the value is less than 0.1 (OD), it is evaluated as 'good' and represented by a circle in FIG. 8. Line L3 in FIG. 8 is described by expression (6) given below, where T is the thickness (μm) of the coating film 38*c* and H is the Asker F hardness (degrees) of the supply roller 38. By using the supply roller 38 which satisfies the condition of expression (6), well-printed images can be obtained with small image density variation while image forming is performed over a long period of time. In other words, image forming can be continued over a long period of time with image density exactly like that of image data to be printed according to print instructions.

$$T \geq -0.15 \times H + 9.6 \quad (6)$$

Line L4 in FIG. 8 is described by expression (7) given below. It is more preferable to use the supply roller 38 which satisfies the condition of expression (7). Better-printed images can be thereby obtained with smaller image density variation while image forming is performed over a long period of time.

$$T \geq -0.27 \times H + 18.1 \quad (7)$$

If the hardness (e.g., Asker F hardness) of the base material is low, a touch of the supply roller 38 with the developing roller 36 causes stress on the surface of the supply roller 38 to be reduced, and the supply roller 38 cannot touch the developing roller 36 with an appropriate pressure. To cope with this problem, the coating film 38*c* is formed on the surface of the supply roller 38 in the present embodiment. By forming the coating film 38*c*, the stress relaxation progresses more slowly and the supply roller 38 can touch the developing roller 36 with an appropriate pressure. This makes it possible to supply an appropriate amount of the toner 3 from the supply roller 38 to the developing roller 36, and therefore well-printed images can be obtained. Moreover, by forming the coating film as the surface film of the supply roller 38, abrasion loss caused by that the supply roller 38 rubs against the developing roller 36 can be reduced, and therefore high-quality image forming can be maintained over a longer period of time.

Figure 9:
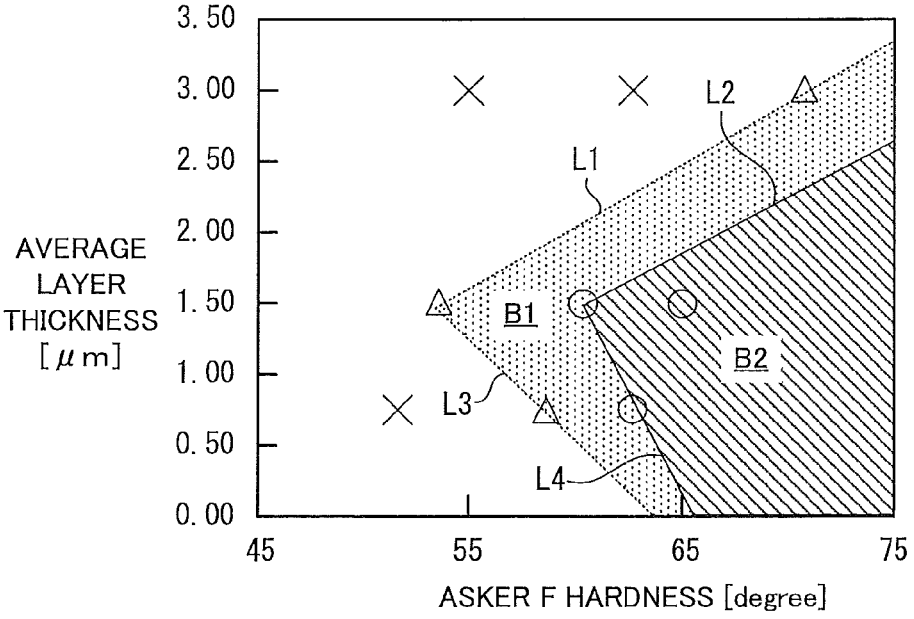
FIG. 9 is a diagram showing a relationship between the thickness (average film thickness) and hardness (Asker F hardness) of the coating film, based on the results of faint print evaluation and image density evaluation.

FIG. 9 shows a relationship between the result of the faint print evaluation shown in Table 2 and the result of the image density evaluation (i.e., the evaluation result of the lower density variation) shown in Table 3. In FIG. 9, with respect to the result of the faint print evaluation shown in Table 2 and the result of the image density evaluation (i.e., the values of the lower density variation) shown in Table 3, if both of the results are 'good', it is represented by a circle; if either one is 'standard' and the other is 'good', it is represented by a triangle; if at least one of the results is 'poor', it is represented by a cross. A region B1 in FIG. 9 satisfies condition (8) given below which is obtained from expressions (4) and (6).

In condition (8), T represents the thickness (μm) of the coating film 38*c* and H represents the Asker F hardness (degrees) of the supply roller 38. By using the supply roller 38 which has the coating film 38*c* having the thickness and hardness within a range of the region B1, well-printed images can be obtained with less faint print and small image density variation, while image forming is performed over a long period of time.

$$T \leq 0.1 \times H - 3.9 \text{ and } T \geq -0.15 \times H + 9.6 \quad (8)$$

It is more preferable to use the supply roller 38 which has the coating film 38*c* having the thickness and hardness within a range of a region B2 in FIG. 9. The region B2 satisfies condition (9) given below which is obtained from expressions (5) and (7). By using the supply roller 38 which has the coating film 38*c* having the thickness and hardness within the range of the region B2, better-printed images can be obtained with further less faint print and smaller image density variation, while image forming is performed over a long period of time.

$$T \leq 0.08 \times H - 3.58 \text{ and } T \geq -0.27 \times H + 18.1 \quad (9)$$

As described above, the developer supply member in the present embodiment has a coating film formed on a surface of its base material having a closed-cell foam structure, and a thickness of the coating film and Asker F hardness measured on a surface of the coating film satisfy expression (4), (6) or (8). Therefore, it is possible to make the developer supply member touch the developer carrier with an appropriate pressure, to reduce abrasion loss of the developer supply member, and to perform high-quality image forming.

What is claimed is:

1. A developer supply member, comprising:

a rotation shaft;

a base material which covers the rotation shaft and has a closed-cell foam structure containing a silicone rubber as a main constituent; and a coating film formed on an outer surface of the base material;

the developer supply member satisfying an expression of $T \geq -0.15 \times H + 9.6$, and $54 \leq H \leq 69$, where T is a thickness of the coating film measured in micrometers and H is Asker F hardness measured in degrees on a surface of the coating film.

2. The developer supply member according to claim 1, wherein the Asker F hardness H and the thickness T satisfy an expression of $T \geq -0.27 \times H + 18.1$ and $61 \leq H \leq 69$.

3. A developer supply member, comprising:

a rotation shaft;

a base material which covers the rotation shaft and has a closed-cell foam structure containing a silicone rubber as a main constituent; and a coating film formed on an outer surface of the base material;

the developer supply member satisfying an expression of $T \geq 0.1 \times H - 3.9$ and $54 \leq H \leq 69$, where T is a thickness of the coating film measured in micrometers and H is Asker F hardness measured in degrees on a surface of the coating film.

4. The developer supply member according to claim 3, wherein the Asker F hardness H and the thickness T satisfy an expression of $T \leq 0.08 \times H - 3.58$ and $61 \leq H \leq 69$.

5. The developer supply member according to claim 3, wherein the Asker F hardness H and the thickness T satisfy an expression of $T \geq -0.15 \times H + 9.6$ and $54 \leq H \leq 69$.

6. A developer supply member, comprising:

a rotation shaft;

a base material which covers the rotation shaft and has a closed-cell foam structure containing a silicone rubber as a main constituent; and a coating film formed on an outer surface of the base material;

the developer supply member satisfying expressions of $T \leq 0.08 \times H - 3.58$ and $T \geq -0.27 \times H + 18.1$, and $54 \leq H \leq 69$, where T is a thickness of the coating film measured in micrometers and H is Asker F hardness measured in degrees on a surface of the coating film.

7. The developer supply member according to claim 1, wherein the coating film is a high polymer film.

8. The developer supply member according to claim 1, wherein the thickness T of the coating film ranges from 0.75 μm to 3.0 μm.

9. The developer supply member according to claim 1, wherein the base material has an average cell diameter of that ranges from 80 μm to 120 μm.

10. A developing unit, comprising:

the developer supply member according to claim 1; and a developer carrier which carries a developer supplied by the developer supply member.

11. An image forming apparatus comprising the developing unit according to claim 10.

* * * * *